US005535724A

United States Patent [19]

Davis

[11] Patent Number: 5,535,724

[45] Date of Patent: Jul. 16, 1996

[54] FUEL PULSATION DAMPENER

[75] Inventor: Stephen D. Davis, Ann Arbor, Mich.

[73] Assignee: Davco Manufacturing L.L.C., Saline, Mich.

[21] Appl. No.: 518,339

[22] Filed: Aug. 23, 1995

[51] Int. Cl.[6] ..... F02M 37/04

[52] U.S. Cl. ..... 123/467; 123/516; 123/447

[58] Field of Search ..... 123/516, 514, 123/447, 510, 512, 467, 456; 137/590, 587, 576, 572, 571, 565

[56] References Cited

U.S. PATENT DOCUMENTS

| | | | |
|---|---|---|---|
| 1,067,814 | 7/1913 | Higginson et al. . | |
| 2,191,490 | 2/1940 | Mitterer | 123/516 |
| 2,323,525 | 7/1943 | Ebel et al. . | |
| 2,414,158 | 1/1947 | Mock | 123/516 |
| 2,774,374 | 12/1956 | Schneider . | |
| 2,790,163 | 4/1957 | Armstrong et al. . | |
| 2,878,889 | 3/1959 | Gilbert | 123/516 |
| 2,917,068 | 12/1959 | Davis . | |
| 3,326,264 | 6/1967 | Howard . | |
| 3,416,506 | 12/1968 | Steiger | 123/467 |
| 3,567,263 | 4/1970 | Long . | |
| 3,612,079 | 10/1971 | Schillinger . | |
| 4,161,964 | 7/1979 | Greiner et al. . | |
| 4,264,287 | 4/1981 | Ishida et al. . | |
| 4,445,829 | 5/1984 | Miller . | |
| 4,512,884 | 4/1985 | Wheatley . | |
| 4,554,902 | 11/1985 | Atkins . | |
| 4,579,653 | 4/1986 | Davis . | |
| 4,589,395 | 5/1986 | Timms | 123/516 |
| 4,590,796 | 5/1986 | Baatz . | |
| 4,649,884 | 3/1987 | Tuckey . | |
| 4,706,636 | 11/1987 | Davis . | |
| 4,986,907 | 1/1991 | Uzeta | 123/516 |
| 5,052,437 | 10/1991 | Danna . | |
| 5,253,628 | 10/1993 | Brown | 123/518 |
| 5,277,166 | 1/1994 | Freeland | 123/510 |
| 5,307,782 | 5/1994 | Davis | 123/467 |
| 5,311,850 | 5/1994 | Martin | 123/467 |
| 5,372,116 | 12/1994 | Davis . | |
| 5,389,245 | 2/1995 | Jaeger | 123/516 |

FOREIGN PATENT DOCUMENTS

| | | | |
|---|---|---|---|
| 0153695 | 9/1985 | European Pat. Off. . | |
| 0261095 | 3/1988 | European Pat. Off. . | |
| 841189 | 5/1939 | France | 123/516 |
| 3843840 | 6/1990 | Germany . | |

*Primary Examiner*—Carl S. Miller
*Attorney, Agent, or Firm*—Young & Basile

[57] ABSTRACT

A fuel pulsation dampener for reducing and dampening fuel pressure pulsations and for checking excessive back flow or siphoning of fuel on both the supply side and return side of the fuel lines in order to maintain fuel levels within the fuel injectors of an internal combustion engine during the starting and stopping of the engine. The fuel pulsation dampener provides a housing having a first and second enclosed chambers that remain in communication with one another via a passageway. The first chamber provides a first inlet and a first outlet wherein the first inlet communicates pressurized fuel into the first chamber. The first outlet has at least one port for communicating fuel in the first chamber downstream of the first chamber to the fuel injectors of the engine. The second chamber provides a second outlet and a second inlet wherein the second inlet communicates fuel into the second chamber from upstream of the second chamber. The second outlet of the second chamber has a port for communicating fuel and vapor from the second chamber to downstream of the second chamber. The ports of the first and second outlets and inlets open into their respective chambers at such horizontal levels that a sufficient reservoir of fuel is maintained within the fuel injectors of the engine in order to enhance the start up performance of the engine.

19 Claims, 2 Drawing Sheets

FUEL PULSATION DAMPENER

FIELD OF THE INVENTION

The present invention relates to fuel delivery systems and, in particular, to a fuel pulsation dampener for dampening fuel pulsations created by the ingestion of fuel by fuel injectors and for a providing an anti-siphoning feature that functions to check excessive back flow of fuel on both the supply side and return side of the fuel delivery system.

BACKGROUND OF THE INVENTION

Fuel systems for internal combustion engines, and, in particular, diesel, gasoline and turbine engines have a high pressure fuel pump which is actuated in timed relationship to deliver fuel under pressure to the combustion spaces of the engine. Examples are new generations of electronically-controlled diesel engines which have unit injectors and gasoline engines with injectors located at either the throttle body or the individual cylinders. Air and fuel vapor can cause malfunctions or "vapor lock" in these systems and prevent proper metering of the fuel for injection and proper combustion. The emerging new diesel and gasoline/gasohol engines which utilize injectors operate with an excess of fuel that is returned to the fuel tank, tending to create pressure pulsations as the injectors open and close during normal operation. When a flowing liquid is suddenly stopped, interrupted or exposed to certain valving action, a pressure wave is created since the fluid is not sufficiently elastic to absorb the energy, pressure waves or pulsations created in the fluid. The pulsations travel back through the incoming column of fuel to the fuel pump and other components, such as sensors, where the pulsations may cause fatigue damage, decrease the efficiency of the fuel pump and harm valves, gaskets, fasteners, sensors and other fuel system components.

Many fuel system apparatuses and methods have been created in an attempt to reduce the magnitude of the pressure pulsations caused by the sudden closing of the valves or injectors and by the abrupt halting of moving fluid. One such known apparatus and method is to utilize a pressurized reservoir by which incoming fuel is pumped into the reservoir from the fuel pump. Once the reservoir is pressurized, the fuel is forced out of the reservoir wherein the fuel travels downstream to the fuel injectors of the engine. Such fuel reservoirs may allow for dampening of pulsations within the fuel as well as allowing for the purging of air and vapor that may exist within the fuel, but such fuel reservoirs are subject to excessive back flow or siphoning of the fuel such that fuel is allowed to drain back from the fuel injectors upon the fuel delivery system being shut down. When the fuel delivery system is shut down, the fuel pump stops delivering pressurized fuel to the reservoir, and atmospheric pressure is allowed to enter the system via the fuel tank thus creating a siphoning effect between the fuel reservoir and the fuel injectors of the engine. When the siphon occurs, the fuel from the fuel injectors may drain back to the fuel tank or back to the reservoir such that the fuel level in the fuel injectors of the engine may become so low that the fuel injectors do not have a sufficient amount of fuel to start the engine upon restarting the system. Thus, the fuel injectors may not have an ample amount of fuel to start the engine until the fuel pump reprimes and refills the entire fuel delivery system.

Other known designs have addressed this problem by mounting a fuel reservoir adjacent the fuel gallery of the engine so that the desired fuel level in the fuel gallery corresponds to a desired fuel level in the fuel reservoir. The desired fuel level maintains a sufficient amount of fuel within the fuel gallery when the fuel delivery system is shut down so that the engine will restart quickly and efficiently. Such a solution has a major drawback in that it is dependent on the fuel reservoir being mounted and maintained at a predetermined level corresponding to the fuel level within the fuel gallery of the engine. Thus, if the fuel reservoir is mounted too high or too low or at an angle with respect to the engine, the level of fuel within the fuel gallery and the fluid reservoir may be affected thus affecting the start-up performance of the engine. In addition, such known designs are placed within the incoming or supply side of the fuel line, and therefore, the return or exiting side of the fuel line does not prevent the drain-back of fuel caused by excessive back flow.

Thus, it would be desirable to provide an apparatus and method for reducing the magnitude of the pressure pulsations created by the sudden closing of valves and injectors and by the abrupt halting of moving fluid. It would also be desirable to provide an apparatus and method that would function to check excessive back flow and siphoning of fluids on both the supply and return sides of the fuel line so as to maintain a sufficient level of fuel within the fuel injectors during starting and stopping of the engine.

SUMMARY OF THE INVENTION

The present invention solves the above-noted shortcomings by providing a fuel pulsation dampener disposed between a fuel pump and the fuel injectors and/or fuel gallery of an internal combustion engine and between a fuel tank and the fuel injectors and/or gallery of the internal combustion engine for reducing and dampening pressure pulsations to levels which will not injure the engine components or degrade engine operation. The fuel pulsation dampener also checks excessive back flow or siphoning of the fuel in order to maintain sufficient fuel levels within the fuel injectors and/or fuel gallery of the internal combustion engine during the starting and stopping of the fuel delivery system so as not to effect the starting performance of the internal combustion engine. This is accomplished by providing a fuel pulsation dampener with means for defining a first chamber and a second chamber. The first chamber defining means provides a first inlet and a first outlet wherein the first inlet has a port opening into the first chamber defining means at a predetermined horizontal level for communicating pressurized fuel into the first chamber defining means. The first outlet of the first chamber defining means has at least one port for communicating fuel in the first chamber defining means to the first outlet for communication of fuel downstream of the first chamber defining means such as the fuel injectors of the engine. All of the ports of the first outlet open into the first chamber defining means at a horizontal level lower than the port of the first inlet whereby pulsations generated downstream of the first outlet are communicated to and dissipated in the first chamber defining means.

The second chamber defining means is in communication with the first chamber defining means wherein the second chamber defining means provides a second outlet and a second inlet. The second inlet of the second chamber defining means communicates fuel into the second chamber defining means from upstream of the second chamber defining means, such as the fuel injectors of the engine. The second outlet of the second chamber defining means has a port for communicating fuel in the second chamber defining means to the second outlet for communication of fuel and vapor downstream of the second chamber defining means, such as the fuel tank, and the port of the second outlet opening into the second chamber defining means at a horizontal level that is below the port of the first inlet and above the port of the first outlet so as to maintain fuel within the fuel injectors and/or fuel gallery of the engine and the first and second chamber defining means.

The communication between the first chamber defining means and the second chamber defining means is provided by a continuously open conduit or passageway having opposite ends opening into the first and second chamber defining means. One end of the passageway has a bleed orifice opening into the first chamber defining means, and the opposite end of the passageway has a relatively large aperture opening into the second chamber defining means. The bleed orifice provided in the first chamber defining means allows for the purging of entrained fuel and vapor while also regulating and maintaining the pressurization of the first chamber defining means upon the first chamber defining means filling with pressurized fuel. Once the first chamber defining means is filled with pressurized fuel, fuel is forced through the ports of the first outlet and communicated downstream to the fuel injectors of the internal combustion engine.

The second inlet of the second chamber defining means provides a bleed orifice that opens into the second chamber defining means. The bleed orifice of the second inlet communicates excess fuel from the fuel injectors of the internal combustion engine, upstream from the second chamber defining means, into the second chamber defining means. The bleed orifice creates back pressure to the fuel injectors of the internal combustion engine in order to maintain and provide a sufficient supply of fuel to the fuel injectors of the internal combustion engine.

Preferably, the first and second chamber defining means are disposed and formed within a central housing. The first and second chamber defining means may be coaxially formed within the housing such that the second chamber defining means has a cylindrical configuration, and the first chamber defining means has a cylindrical ring configuration that encompasses the second chamber defining means.

It is therefore an object of the present invention to provide a fuel pulsation dampener which will reduce the magnitude of pressure pulsations, automatically purge entrained air, gases and the like and function as an anti-siphoning device for both the supply side and the return side of the fuel delivery system.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
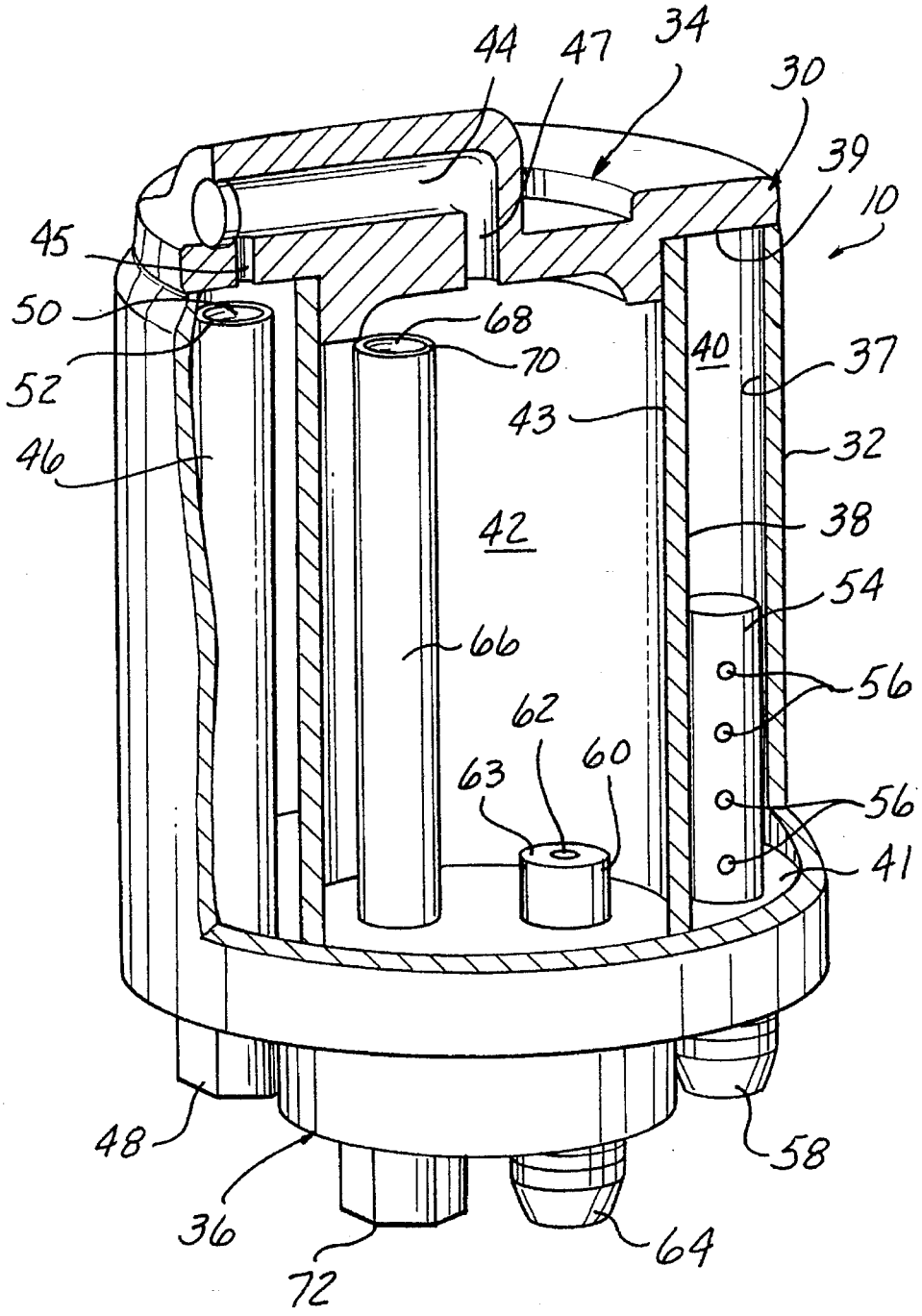
FIG. 1 is a pictorial view of an internal combustion engine showing a fuel pulsation dampener employed within the fuel system thereof.
Figure 2:
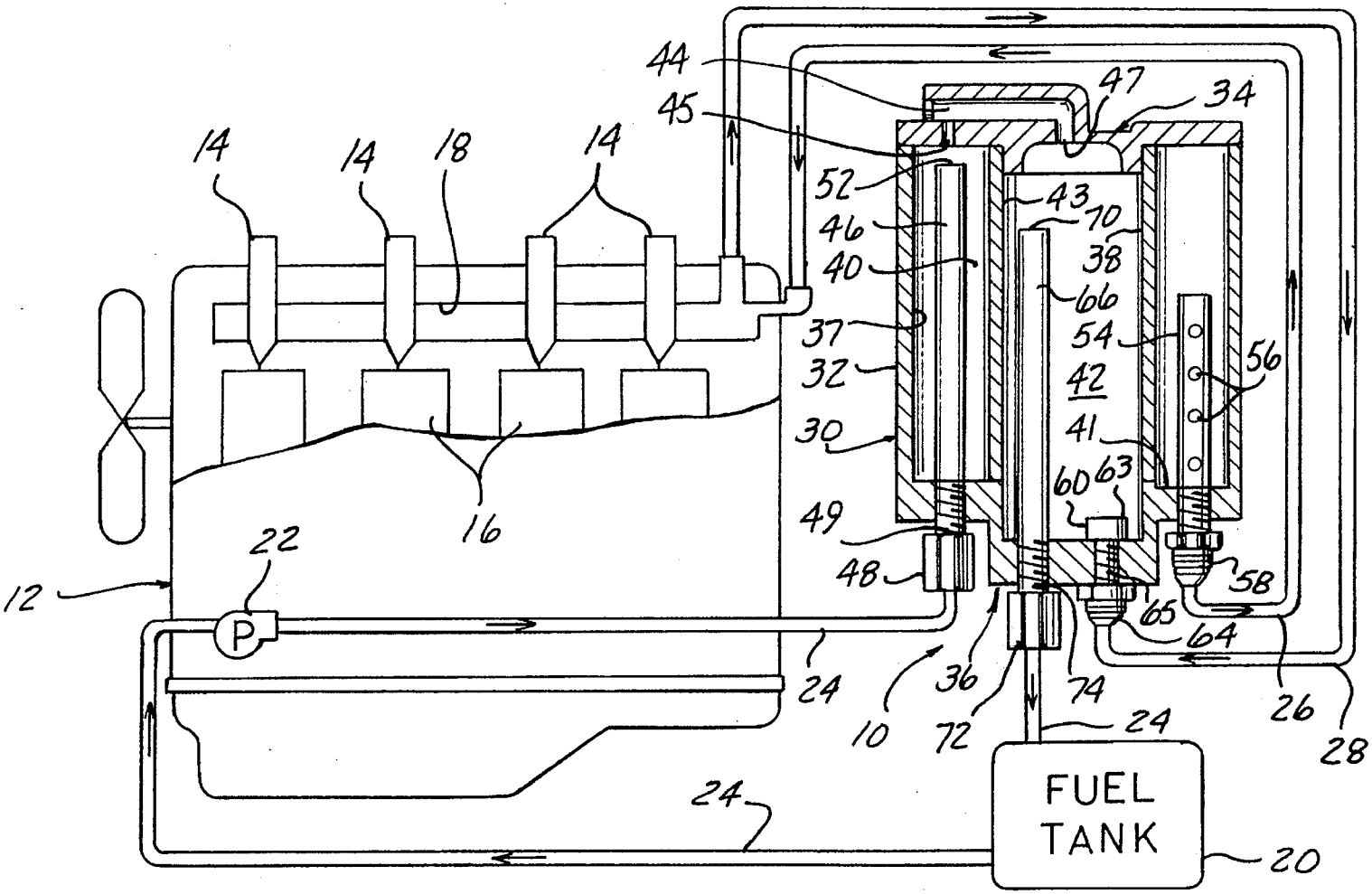
FIG. 2 is a perspective view of the fuel pulsation dampener wherein some portions are broken-away in order to show the internal configuration of the fuel pulsation dampener.

FIGS. 1 and 2 illustrate one example of the present invention in the form of a fuel pressure pulsation dampener 10 which is used in the fuel system of an internal combustion engine 12. The engine 12 is of the type that utilizes fuel injectors 14 to communicate a predetermined amount of fuel under pressure to the chambers 16 of the engine 12 for combustion therein in the conventional manner. Fuel is communicated to each of the fuel injectors 14 through a fuel gallery 18. While the preferred embodiment of the present invention is disclosed in connection with an internal combustion engine 12 that utilizes diesel fuel, it should be understood that the invention may find equal application with use in gasoline and alternate fueled and gasohol fueled engines. In the internal combustion engine 12, fuel stored in a fuel tank 20 is delivered under pressure by means of a fuel pump 22 and a fuel conduit 24 to the fuel pulsation dampener 10. The fuel pulsation dampener 10 is preferably positioned at the highest elevation or point within the fuel system. Fuel is then communicated from the fuel pulsation dampener 10 through a fuel feed line 26 to the fuel gallery 18. The fuel injectors 14 open and close to ingest fuel, and the excess fuel is returned from the fuel gallery 18 to the fuel pulsation dampener 10 via a fuel return line 28. The fuel conduit 24 carries excess fuel and vapor from the fuel pulsation dampener 10 to the fuel tank 20.

For the fuel pulsation dampener 10 to dampen the fuel pulsations as well as prevent excessive back flow or siphoning of the fuel between the fuel pulsation dampener 10 and the internal combustion engine 12, the fuel pulsation dampener 10 provides a first chamber defining means and a second chamber defining means that are both disposed and formed within a single housing 30. The housing 30 has a cylindrical configuration with an outer wall 32, a top 34, and a bottom 36. The first chamber defining means includes an inner surface 37 of the outer wall 32 of the housing 30, an inner cylindrical wall 38 of the housing 30, and an inner surface 39, 41 of the top 34 and bottom 36, respectively, of the housing 30 to define a first chamber 40 having an enclosed cylindrical ring configuration. The housing 30 also provides a second chamber defining means having an inner surface 43 of the inner cylindrical wall 38, the inner surface 39 of the top 34, and the inner surface 41 of the bottom 36 of the housing 30 to define the second chamber 42. The second chamber 42 has an enclosed, cylindrical, hollow configuration for housing excess fuel. The first chamber 40 and the second chamber 42 are placed in communication with one another by a continuously open passageway or conduit 44 which extends from the first chamber 40 to the second chamber 42 through the top 34 of the housing 30. The passageway 44 has a small bleed orifice 45 which opens into the first chamber 40 through the inner surface 39 of the top 34 of the housing 30. The opposite end 47 of the passageway 44 has a larger opening than the bleed orifice 45 and opens into the second chamber 42 through the inner surface 39 of the top 34 of the housing 30.

In order to dampen the fuel pulsations created by the fuel injectors 14 of the engine 12 downstream from the first chamber 40, a first inlet tube 46 extends upward into the first chamber 40. The first inlet tube 46 has a cylindrical hollow configuration with a bottom end 49 of the inlet tube 46 extending through the bottom 36 of the housing 30 wherein a fitting 48 is utilized to connect the fuel conduit 24 to the fuel inlet tube 46. The first inlet tube 46 has a port 50 at the top end 52 of the first inlet tube 46 wherein pressurized fuel is communicated into the first chamber 40 from the fuel pump 22. The port 50 of the first inlet tube 46 opens into the first chamber 40 at a predetermined horizontal height.

To communicate fuel downstream of the first chamber 40 to the fuel injectors 14 of the engine 12, a first outlet tube 54 extends upward into the first chamber 40, preferably on the opposite side of the first chamber 40 as compared to the first inlet tube 46 in a non-coaxial relationship so as to maximize the time and space provided for dampening and reducing the fuel pulsations. The first outlet tube 54 has a hollow cylindrical configuration with three ports or apertures 56 extending through the sides of the first outlet tube 54 and opening into the first chamber 40. The ports 56 of the first outlet tube 54 must all open into the first chamber 40 at a horizontal level that is below the horizontal level of the port 50 of the first inlet tube 46. The first outlet tube 54 extends through the bottom 36 of the housing 30 wherein a coupling 58 is attached to the first outlet tube 54 and the fuel feed line 26 is coupled to the coupling 58 of the first outlet tube 54.

In order to prevent excessive back flow or siphoning of the fuel, the second chamber 42 has an inlet tube 60 extending upward through the bottom 36 of the housing 30. The second inlet tube 60 has a hollow cylindrical configuration with a small, continuously open bleed orifice 62 at a top end 63 of the second inlet tube 60 opening into the second chamber 42. The second inlet tube 60 extends through the bottom 36 of the housing 30 and has a coupling 64 connected to a bottom end 65 of the second inlet tube 60. The coupling 64 is coupled to the fuel return line 28. The small bleed orifice 62 in the second inlet tube 60 provides back pressure to the fuel injectors 14 to maintain proper performance of the engine 12.

To relieve the fuel pulsation dampener 10 of excess fuel and vapor, a second outlet tube 66 extends upward through the bottom 36 of the housing 30. The second outlet tube 66 has a hollow cylindrical configuration with a port 68 opening into the second chamber 42 at a top end 70 of the second outlet tube 66. The port 68 opens into the second chamber 42 at a horizontal level that is below the port 50 of the first inlet tube 46 and above the ports 56 of the first outlet tube 54. The second inlet tube 60 and the second outlet tube 66 are positioned in a non-coaxial configuration within the second chamber 42 to ensure a proper accumulation of fuel within the second chamber 42 by preventing fuel from the second inlet tube 60 from passing directly into the second outlet tube 66. The second outlet tube 66 extends through the bottom 36 of the housing 30 wherein a coupling 72 is connected to a bottom end 74 of the second outlet tube 66. The coupling 72 is coupled to a fuel conduit 24 that extends directly to the fuel tank 20.

In operation, fuel is pumped from the fuel tank 20 through the fuel conduits 24 by the fuel pump 22. Pressurized fuel is pumped through the first inlet tube 46 and communicated into the first chamber 40. The first chamber 40 begins to fill with fuel as air and vapor are purged through the passageway 44 and into the second chamber 42. Once the first chamber 40 is filled with fuel, fuel is forced through the ports 56 of the first outlet tube 54 and communicated downstream to the fuel injectors 14 of the engine 12. The bleed orifice 62 of the passageway 44 allows for relief of excessive pressure while also maintaining the proper level of fuel pressure within the first chamber 40. As the fuel injectors 14 ingest fuel, fuel pulsations are transmitted through the fuel feed line 26 wherein they travel through the ports 56 of the first outlet tube 54 and are communicated to and dissipate within the first chamber 40.

As the unit injectors 14 are ingesting fuel, excessive fuel is communicated through the fuel return line 28 and communicated into the second chamber 42 through the second inlet tube 60. The bleed orifice 62 provided in the second inlet tube 60 allows for excessive fuel to be communicated into the second chamber 42 while also maintaining back pressure to the fuel injectors 14 of the engine 12 to provide proper performance of the engine 12. As the second chamber 42 begins to fill with fuel, any excessive vapor or fuel will escape through the port 66 of second outlet tube 66 and communicate through the fuel conduits 24 into the fuel tank 20.

Due to the fuel reservoirs created in both the first chamber 40 and the second chamber 42, excessive back flow or siphoning of fuel between the fuel pulsation dampener 10 and the unit injectors 14 of the engine 12 is prevented. The horizontal level of the port 50 of the first inlet tube 46 and the port 68 of the second outlet tube 66 ensure that both the first chamber 40 and the second chamber 42 will maintain fuel levels that are slightly below the port 68 of the second outlet tube 66. The abundant fuel level within the fuel pulsation dampener 10 ensures that an ample supply or level of fuel is provided within the fuel gallery 18 and fuel injectors 14 of the engine 12 as well as the fuel feed line 26 and the fuel return line 28 so that the start up of the engine 12 is uninhibited by the stopping and starting of the fuel system within the engine 12.

It should be noted that the present invention is not limited to the first and second chambers being disposed within a single housing, but rather, the first and second chambers may be independent and separable wherein a conduit maintains communication between the separate chambers.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A fuel pulsation dampener comprising:

means for defining a first chamber having a first inlet and a first outlet;

said first inlet having a port opening into said first chamber defining means at a horizontal level for communicating pressurized fuel into said first chamber defining means;

said first outlet having at least one port for communicating fuel downstream of said first chamber defining means, and said port of said first outlet opening into said first chamber means at a horizontal level lower than said port of said first inlet whereby pulsations generated downstream of said first outlet are communicated to and dissipated within said first chamber defining means;

means for defining a second chamber wherein said first chamber defining means is in communication with said second chamber defining means, and said second chamber defining means having a second outlet and a second inlet wherein said second inlet communicates fuel into said second chamber defining means from upstream of said second chamber defining means; and said second outlet having a port for communicating fuel and vapor downstream of said second chamber defining means, and said port of said second outlet opening into said second chamber defining means at a horizontal level that is below said port of said first inlet and above said port of said first outlet so as to maintain fuel within and between a fuel injector and said first and second chamber defining means.

2. The fuel pulsation dampener stated in claim 1 wherein said communication between said first and second chamber defining means comprises:

a conduit having a small orifice opening into said first chamber defining means for maintaining fluid pressure within said first chamber defining means, and an opposite end of said conduit opening into said second chamber defining means for communicating fuel and vapor between said first and second chamber defining means.

3. The fuel pulsation dampener stated in claim 1, further comprising:

said second inlet having a small orifice opening into said second chamber defining means for maintaining back pressure upstream from said second chamber defining means.

4. The fuel pulsation dampener stated in claim 1, further comprising:

a housing having said first and second chamber defining means disposed therein.

5. A fuel pulsation dampener for a fuel injected engine having at least one fuel injector, said dampener comprising:

a housing having a first chamber in communication with a second chamber;

a first inlet tube extending into said first chamber and having a port opening into said first chamber at a predetermined level for communicating pressurized fuel into said first chamber;

a first outlet tube extending into said first chamber for communicating pressurized fuel downstream of said first chamber, and said first outlet tube having at least one port opening into said first chamber at a level lower than said port of said first inlet tube whereby pulsations generated downstream of said port of said first outlet tube by said at least one fuel injector of said engine are communicated to and dissipated in said first chamber;

a second inlet tube extending into said second chamber for receiving excess fuel from upstream said second chamber; and a second outlet tube extending into said second chamber for communicating excess fuel and vapor from within said second chamber to downstream said second chamber wherein said second outlet tube has a port opening into said second chamber at a level below said port of said first inlet tube and at a level above said port in said first outlet tube so as to maintain a sufficient level of fuel within said fuel injector and said housing for proper operation of said engine.

6. The fuel pulsation dampener stated in claim 5, further comprising:

a conduit for providing communication between said first and second chambers wherein one end of said conduit has a small bleed orifice opening into said first chamber for maintaining pressure within said first chamber, and said other end of said conduit opening into said second chamber for communicating fuel and vapor between said first and second chambers.

7. The fuel pulsation dampener stated in claim 6, further comprising:

said conduit remaining continuously open.

8. The fuel pulsation dampener stated in claim 5, further comprising:

said second inlet tube having a small bleed orifice opening into said second chamber for providing back pressure upstream from said second chamber.

9. The fuel pulsation dampener stated in claim 8, further comprising:

said bleed orifice in said second inlet tube remaining continuously open.

10. The fuel pulsation dampener stated in claim 5, further comprising:

said first outlet tube having a plurality of ports opening into said first chamber.

11. The fuel pulsation dampener stated in claim 5, further comprising:

said first and second chambers having cylindrical configurations and coaxially positioned within said housing.

12. An improved fuel pulsation dampener for a fuel injected system having a fuel pump for pumping fuel from a fuel source, at least one fuel injector, and a fuel conduit for placing said fuel pump in communication with said at least one fuel injector, the improvement comprising:

a housing having an enclosed first chamber and an enclosed second chamber;

a first inlet tube extending into said first chamber and having a port opening into said first chamber at a predetermined horizontal level for communicating pressurized fuel from said fuel conduit into said first chamber;

a first outlet tube extending into said second chamber and having a plurality of ports for communicating pressurized fuel in said first chamber to said first outlet tube for communication of said pressurized fuel through said fuel conduit downstream of said first chamber, and each of said plurality of ports opening into said first chamber at a point below said horizontal level of said port of said first inlet tube whereby pressurized fuel is forced out of said first chamber only after said pressurized fuel has filled said chamber wherein pulsations generated downstream of said first outlet tube by said at least one fuel injector of said engine are communicated to and dissipated in said first chamber;

a passageway extending within said housing and between said first and second chambers wherein one end of said passageway has a bleed orifice opening into said first chamber, and another end opens into said second chamber wherein said passageway allows excess fuel and vapor from said first chamber to be communicated to said second chamber while maintaining the pressurization of said first chamber;

a second inlet tube extending into said second chamber and having a bleed orifice for communicating excessive fuel into said second chamber through said fuel conduit upstream of said second chamber, and said bleed orifice providing sufficient back pressure to said fuel conduit upstream of said second chamber for proper performance of said engine; and a second outlet tube extending into said second chamber for communicating excess fuel and vapor from said second chamber to said fuel conduit downstream of said second chamber, and said second outlet tube having a port opening into said second chamber at a horizontal level lower than said port of said first inlet tube and higher than said plurality of ports in said first outlet tube so that a sufficient amount of fuel is maintained within said fuel injector and said first and second chambers of said housing for proper operation of said engine.

13. The improved fuel pulsation dampener stated in claim 12, further comprising:

said first and second chambers having a cylindrical configuration with said first and second chambers coaxially orientated within said housing.

14. The improved fuel pulsation dampener stated in claim 12, further comprising:

said housing having a bottom; and said first and second inlets and said first and second outlets extending upward through said bottom of said housing and opening into said first and second chambers, respectively, of said housing.

15. The improved fuel pulsation dampener stated in claim 12, further comprising:

said passageway remaining continuously open.

16. The improved fuel pulsation dampener stated in claim 12, further comprising:

said bleed orifice in said second inlet remaining continuously open.

17. The improved fuel pulsation dampener stated in claim 12, further comprising:

said first inlet and outlet mounted non-coaxially within said first chamber to ensure dampening of said pulsations.

18. The improved fuel pulsation dampener stated in claim 12, further comprising:

said second inlet and outlet mounted non-coaxially within said second chamber to ensure an accumulation of said fuel within said second chamber.

19. The improved fuel pulsation dampener stated in claim 12, further comprising:

said ends of said passageway opening into said first and second chamber in a non-coaxial relationship with respect to said first and second inlets and outlets to ensure proper communication and accumulation of fuel within said first and second chambers.

* * * * *